US006826890B2

(12) United States Patent
Cere'

(10) Patent No.: US 6,826,890 B2
(45) Date of Patent: Dec. 7, 2004

(54) METHOD FOR MAKING A PACKAGE OF PRODUCTS AND APPARATUS IMPLEMENTING THE METHOD

(75) Inventor: Mauro Cere', Loiano (IT)

(73) Assignee: Aetna Group, S.p.A., Rimini (IT)

( * ) Notice: Subject to any disclaimer, the term of this patent is extended or adjusted under 35 U.S.C. 154(b) by 0 days.

(21) Appl. No.: 10/305,826

(22) Filed: Nov. 27, 2002

(65) Prior Publication Data

US 2003/0097817 A1 May 29, 2003

(30) Foreign Application Priority Data

Nov. 27, 2001 (IT) ..... BO2001A0726

(51) Int. Cl.[7] ..... B65B 21/00; B65B 61/14

(52) U.S. Cl. ..... 53/398; 53/449; 53/413; 53/134.1

(58) Field of Search ..... 53/398, 413, 449, 53/441, 134.1, 176, 48.3, 48.4, 585; 206/428, 432

(56) References Cited

U.S. PATENT DOCUMENTS

| | | | | | |
|---|---|---|---|---|---|
| 3,479,930 | A | * | 11/1969 | Peppler | 53/556 |
| 3,557,516 | A | * | 1/1971 | Brandt | 53/134.1 |
| 3,948,392 | A | * | 4/1976 | Faust | 206/432 |
| 3,999,357 | A | | 12/1976 | Marantz | |
| 4,250,798 | A | * | 2/1981 | Yamato et al. | 53/585 |
| 4,304,332 | A | | 12/1981 | Danti | |
| 4,403,463 | A | * | 9/1983 | Danti | 53/398 |
| 4,454,705 | A | * | 6/1984 | Benno | 53/585 |
| 4,596,330 | A | | 6/1986 | Benno | |
| 4,730,436 | A | | 3/1988 | Angelino | |
| 5,168,989 | A | * | 12/1992 | Benno | 53/398 |
| 5,570,787 | A | * | 11/1996 | Danovaro et al. | 206/428 |

FOREIGN PATENT DOCUMENTS

| | | | | |
|---|---|---|---|---|
| EP | 0442111 | * | 8/1991 | |
| EP | 0 442 111 A2 | | 8/1991 | |
| EP | 0550129 | * | 7/1993 | 53/585 |
| EP | 01830521 | | 8/2001 | |
| IT | 1285827 | | 7/1996 | |
| IT | 01285827 | * | 7/1996 | |
| IT | 018305219 | * | 8/2001 | |

* cited by examiner

*Primary Examiner*—John Sipos
(74) *Attorney, Agent, or Firm*—Fay, Sharpe, Fagan, Minnich & McKee, LLP

(57) ABSTRACT

A method for wrapping groups of products with stretch film comprises the following steps: forming groups of products having a front and a longitudinal dimension that follows a line of feed; placing a first wrapping on the group of products to form a package that holds the products together; expelling the package thus obtained along the feed line; turning the package through an angle of 90°; placing over the first wrapping a second stretch film wrapping on the package thus obtained, the second wrapping having at least one narrowed strap-like segment surrounding a part of the package. The invention also relates to an apparatus that implements this method and the package obtained using the method.

9 Claims, 2 Drawing Sheets

METHOD FOR MAKING A PACKAGE OF PRODUCTS AND APPARATUS IMPLEMENTING THE METHOD

BACKGROUND OF THE INVENTION

The present invention relates to a method for making a package of products and an apparatus that implements the method.

More specifically, the package is obtained from stretch film and it may contain groups of products such as bottles with bases of different shapes—for example, circular, square or rectangular—or even containers made of metal (including parallelepiped shaped containers).

In conventional production lines where the production process includes the wrapping of groups of plastic bottles (to which the present description will hereinafter refer, although the invention may also be applied to other types of product or container), the final wrapping over the groups of bottles usually consists of a sheet of heat-shrink material.

In some cases and for some types of products, these lines may, however, be very expensive for the manufacturer because they have numerous operating units, such as product collating units (especially in the case of continuous lines), and film feed and heating units, all of which require a high number of control devices and accessory parts. Other negative factors to be taken into account when dealing with production lines of this kind are the high cost of the heat shrink film itself and the fact that some products cannot be heated beyond certain limits, which means that heat shrink wrapping solutions are not feasible.

The teachings of prior art also include more economical wrapping solutions adopted instead of heat shrink wrapping methods and machines, but providing standards of quality that are at least as high as those provided by heat shrink wrapping solutions.

One of these alternative solutions is described in patent IT 1.285.827, to the same Applicant as the present. In this solution, a tubular portion of stretch film, that is to say, elastically extensible film, is used in a method where the portion of film is fed by a film feed station and then stretched transversally by a plurality of rods. In this way, the size of the tubular portion of film is enlarged so that its transversal dimension is increased from a minimum size to a size greater than the front of the groups of products. The rods then align the film with the line of product feed so as to enable a single group of products to move into the stretched tube of film. The rods, moving in synchrony with the feed motion of the groups of products, then release the tube of film allowing it to shrink to its former size in such a way that it envelops the package.

This wrapping method is extremely practical, fast and economical compared to heat shrink wrapping methods and its use is currently preferred for many type of products—whether bottles or other containers—to be wrapped with film.

In this connection, and in view also of the greatly increased demand for stretch wrapping, there has also been a growing demand for a new type of end package to meet changing consumer requirements and to facilitate handling.

A first solution is disclosed in European patent application No.01830521.9, by the same Applicant as the present, where a stretch film package is made in the following steps: forming groups of products; winding a stretch film unrolled from a first roll around first means for preforming the wrapping, positioned inside a film wrapping area and along the product group line of feed; forming a first tubular portion of stretch film; stretching the portion of film by moving the first preforming means to create an access area for a single group of products moving along the feed line; releasing the portion of stretch film to allow the film to shrink to its former size over the group of products and thus wrapping it; expelling the wrapped package thus obtained onto the feed line.

The step of expelling the package is followed by the further steps of turning the package through ninety degrees and overwrapping it with a second wrap of stretch film unwound from a second roll. In this way, a highly practical and secure double wrapping is placed over the group of products.

With the aim of improving on, and making better use of, the method just described, where the groups of products are wrapped on the same line as that on which they are being fed, the Applicant has devised and produced a variant of it, together with an apparatus to implement it, and a new type of package, which combines security and stability for the products with ease of handling for the package without adding any further elements to the package itself.

SUMMARY OF THE INVENTION

The aforementioned aim is accomplished by a method for wrapping groups of products with stretch film comprising the following steps: forming groups of products having a front and a longitudinal dimension that follows a line of feed; placing a first wrapping on the group of products to form a package that holds the products together; expelling the package thus obtained along the feed line; turning the package through an angle of 90°; placing over the first wrapping a second stretch film wrapping on the package thus obtained, the second wrapping having at least one narrowed strap-like segment surrounding a part of the package.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
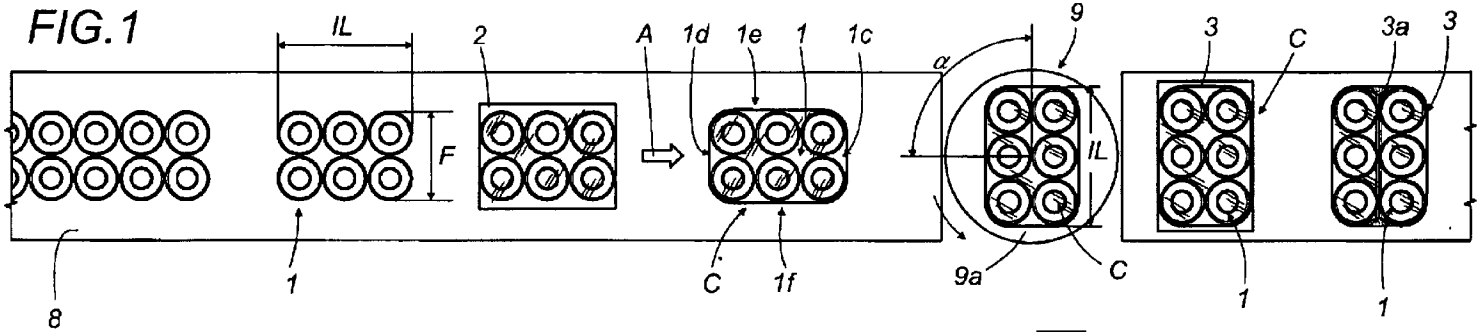
FIG. 1 is a schematic top plan view illustrating the method for wrapping groups of products with stretch film according to the present invention.

With reference to the accompanying drawings, in particular FIG. 1, the method according to the invention is used to wrap groups 1 of products with stretch film.

Purely by way of example, the product groups 1 illustrated in the accompanying drawings consist of bottles. However, without departing from the scope of the inventive concept, the method according to the invention may be applied to any product that needs to be stretch wrapped.

The method basically comprises the following steps (see FIG. 1):

- forming groups 1 of products having a front F and a longitudinal dimension IL following a line of feed A (indicated by the arrow A);
- placing a first wrapping 2 on the group 1 of products to form a package C that holds the products together;
- expelling onto the same feed line A the package C thus obtained;
- turning the package through an angle α of 90°;
- placing over the first wrapping 2 a second stretch film wrapping 3 on the package C thus obtained, the second wrapping 3 having at least one narrowed strap-like segment 3*a* surrounding a part of the package C.

As disclosed also in European patent application No.01830521.9, by the same Applicant as the present and therefore not described in detail here, the step of placing the first wrapping 2 on the group 1 of products is accomplished by forming a first tubular portion 2 of stretch film, which is unrolled from a first roll 4*a* and which is:

- wound around first preforming means 4;
- elastically stretched to create an access area, whose transversal dimension is larger than the front F, for a single group 1 of products moving along the feed line A; and lastly
- released in such a way as to envelop and hold within it the product group 1.

The next step of placing the second wrapping 3 is accomplished by second preforming means 5 having wound around them a second film portion 3 from a second roll 6.

More specifically, this step of placing the second wrapping 3 comprises the following sequence of sub-steps:

- winding a length of stretch film unrolled from a second roll 6 around the second means 5, which are designed to preform an overwrapping and which are positioned inside a film wrapping area along the product group 1 line of feed A;
- forming the second tubular portion 3 of stretch film;
- stretching the second film portion 3 by moving the second preforming means 5 to create for the package C moving along the feed line A an access area whose cross section is at least equal to the longitudinal dimension IL;
- releasing the second film portion 3 to allow the second portion 3 itself to shrink to its former size in such a way as to overwrap the package C, while the gripping means 7 simultaneously release the narrowed film segment 3*a;*
- narrowing down to strap size at least one segment 3*a* of the second film portion 3, this step being performed by gripping means 7 at the same time as the step of releasing the second portion 3;
- expelling the package C thus obtained onto the feed line A.

Alternatively, and without departing from the scope of the inventive concept, the step of narrowing the segment 3*a* to strap size might be performed after the step of forming the second film portion 3 and the step of stretching the second film portion 3.

Figure 2:
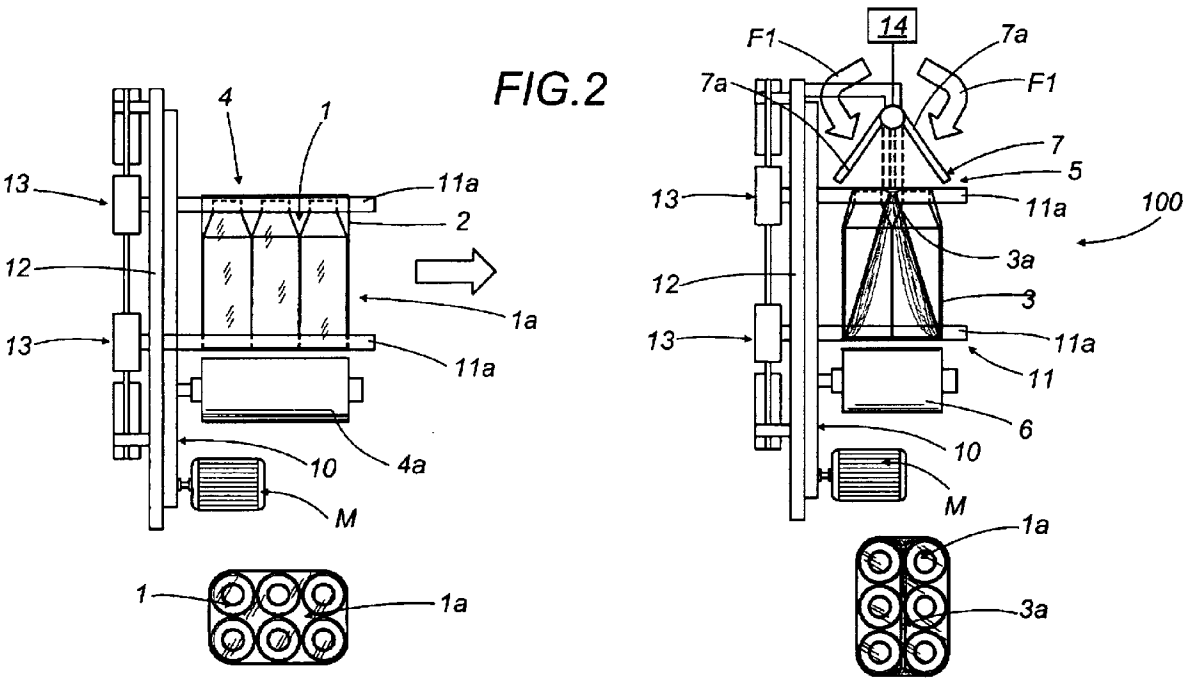
FIG. 2 is a schematic side view of an apparatus designed to implement the method illustrated in FIG. 1.
Figure 3:
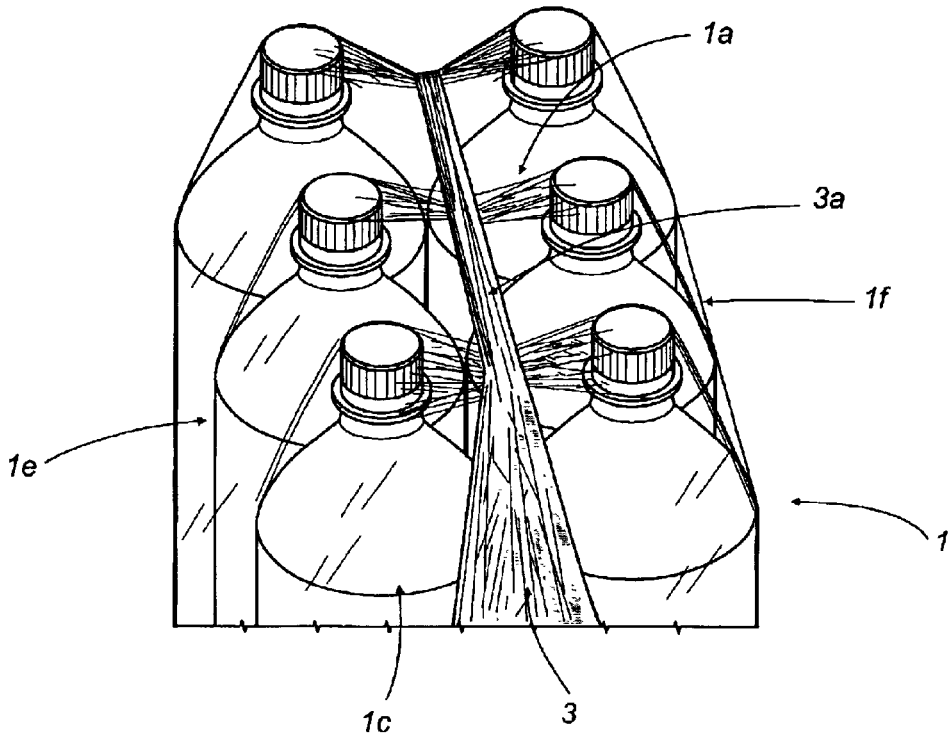
FIG. 3 is a perspective view showing a part of a group of products packaged according to the present invention.
Figure 4:
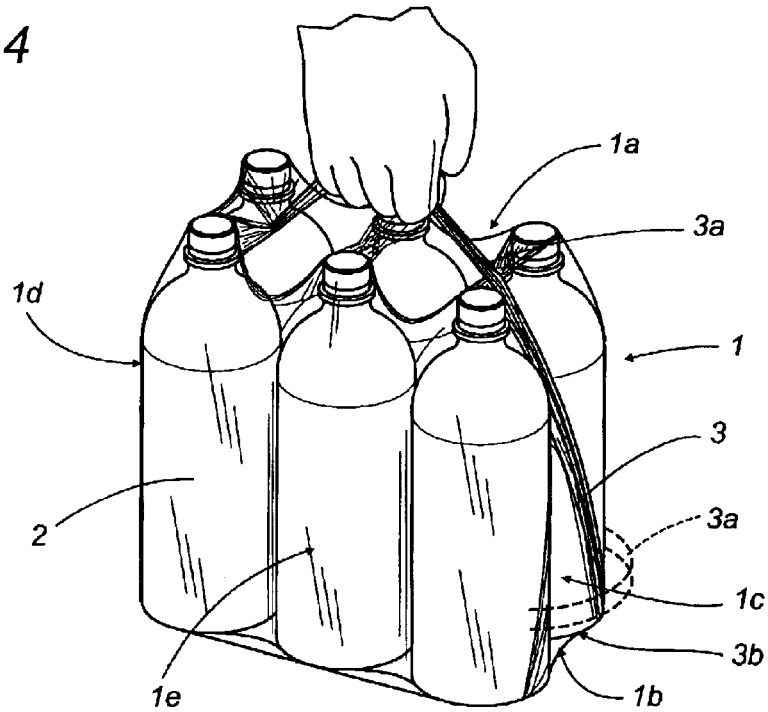
FIG. 4 is a perspective view showing the package of FIG. 3 being carried.

With reference also to FIGS. 2, 3 and 4, the step of narrowing the second stretch film portion 3 to strap size is applied at least to an upper segment 3*a* of it furthest away from a table 8 on which the product group 1 is fed, in such a way as to create an area by which the product group 1 can be held in the hand.

More specifically, the step of narrowing the second film portion 3 to strap size creates two separate areas 3*a* and 3*b* in the wrapping of the product group 1, that is to say, an upper area 3*a* designed to be held in the hand, and a lower area 3*b* wrapped around the base of the product group 1.

The apparatus, labeled 100 in its entirety, for wrapping groups 1 of products with stretch film, comprises at least the following:

- a feed table 8, extending in the direction A, on which the groups 1 of products having a front F and a longitudinal dimension IL are formed;
- a first station 4 for creating the first wrapping 2 to form a package C that holds the product group 1 together, this first station 4 being located along the feed table 8 and forming part of the table 8 itself;
- means 9 for turning each package C through an angle α of 90°, located downstream of the first station 4 relative to the feed line A;
- a second station 6 for placing the second wrapping 3 over the first wrapping 2, located downstream of the turning means 9 and equipped with gripping means 7 designed to narrow the second wrapping 3 to form a strap-like segment 3*a*.

The constructional details of the first station 4 and certain parts of the second station 6 are not described as they are fully described in the Applicant's other European patent application No. 01830521.9.

The turning means 9 may comprise a turntable 9*a* forming part of the feed table 8.

The second station 6 comprises means 10 for unrolling the stretch film and placing a second film portion 3 around the second means 11 for preforming the overwrapping, these unrolling means 10 being located on the feed table 8 and being mobile between several working positions comprising:

- a closed position designed to allow the film to be wound around the preforming means 11;
- a position for infeed of the package C in which the preforming means 11 stretch the second film portion 3 in such a way that the transversal dimension of the film is larger than the longitudinal dimension IL of the package C; and
- a position for expelling the twice wrapped group 1 of products onto the feed table 8.

The preforming means 11 comprise the aforementioned means 7 for gripping the segment 3*a* of the second film portion 3 located above the feed table 8 in such a way as to narrow it down to strap size at an upper area of the package C.

Looking in more detail, the preforming means 11 comprise a plurality of rods 11*a* mounted on a frame 12 and set apart from each other in such a way as to form a tubular space close to the feed table 8.

The frame 12 is equipped with means 13 for moving the rods 11*a* towards and away from each other in such a way as to define the aforementioned closed and package C infeed and expulsion positions.

As clearly shown in FIG. 2, the gripping means 7 comprise a gripper 7*a* positioned above the plurality of rods 11*a* and mobile between: an idle open position where it is away from the second film portion 3; and a closed working position where the gripper 7*a* is closed in on the upper segment 3*a* of the second film portion 3 (see arrows F1 of FIG. 2) at the closed position of the rods 11*a*, that is to say, just before the package is released onto the table 8, so as to form the aforementioned strap-like segment 3*a* of the second stretch film portion 3 forming the top of the package C of products.

As also shown in FIG. 2, the gripper 7*a* is connected to the frame 12 that supports the plurality of rods 11*a* and is connected to a control unit 14 (illustrated as a block since it is of known type) designed to synchronize the movements of the gripper 7*a* and the rods 11*a* in such a way as to narrow the film segment 3*a* to strap size when the rods 11*a* are in the closed position, that is to say, in the position where the second film segment 3*a* has reached its narrowest size just before the package C is expelled.

In other terms, the gripper 7*a* crimps the segment 3*a* of the second stretch film portion 3 and keeps it in this configuration until the second portion 3 itself is released on the package C.

The finished package (see FIGS. 3 and 4) thus comprises a first wrap derived from a first portion 2 of stretch film wrapped around the group 1 of products to form a tubular shape that holds together the group 1 of products, and a second wrap derived from a second portion 3 of stretch film and having a segment 3*a* narrowed down to strap size, separate from the first wrap 2, and forming at least one handle by which the package C thus formed can be carried.

As shown in FIGS. 3 and 4, the second wrap 3, forms a relative tubular surface placed over the first wrap 2.

Alternatively, the second wrap might be formed under the first wrap 3, with only the handle segment 3*a* protruding through the first wrap 2 (see dashed line in FIG. 4).

In the practical solution illustrated in FIGS. 3 and 4, the first and second wraps around the package C form relative tubular surfaces made around wrapping planes that cross each other perpendicularly.

Looking in more detail, the first wrap adheres to the group 1 of products on at least four sides of the product group 1 itself, and the second wrap derived from the second stretch film portion 3, placed over the first portion 2, crossing the latter in such a way as to wrap the product group 1 on at least four sides of the product group 1, of which two are sides left free by the first portion 2, and presenting at least one segment 3*a* narrowed down to a strap-like form along at least one side of the product group 1.

The narrowed strap-like segment 3*a* of the second film portion 3 is positioned on the upper surface 1*a* of the product group 1 to form a handle by which the package C thus obtained can be carried (see FIG. 4).

In practice, in the preferred, non-restricting embodiment illustrated in FIGS. 3 and 4, the first portion 2 is wound around the upper surface 1*a*, the base 1*b* and two lateral surfaces 1*e* and 1*f*, whilst the second film portion 3 is wound around the base 1*b*, two lateral surfaces 1*c* and 1*d* and, with the narrowed strap-like segment 3*a*, the upper surface 1*a*.

The stretch wrapping method and apparatus described above thus achieve the purpose of providing an extremely practical package that does not require any additional elements that would negatively affect both the production process and the cost of the package.

The use of the second stretch film portion with the narrowed strap-like segment forming a handle by which the package can be carried means that no external element needs to be added to the package to complete it.

It will be understood that the invention can be subject to modifications and variations without thereby departing from the scope of the inventive concept. Moreover, all the details of the invention may be substituted by technically equivalent elements.

What is claimed is:

1. A method for wrapping groups of products with stretch film comprising at least the following steps:

forming groups of individual products having a front and a longitudinal dimension following a line of feed, each individual product having a width;

placing a first wrapping on the group of products to form a package that holds the products together;

feeding onto the feed line the package thus obtained, and wherein the feeding step is followed by the further steps of:

turning each package through an angle of 90°;

placing over the first wrapping a second stretch film wrapping on the package thus obtained and forming the second stretch film wrapping to include: (i) an upper area having a width less than the width of each individual product; and (ii) a lower area having a width that supports width of at least two of the individual products, said upper area of the second stretch film defining at least one narrowed strap-like segment surrounding a part of the package.

2. The method according to claim 1, wherein the step of placing the second wrapping is performed by respective preforming means around which a film portion from a roll is wound.

3. The method according to claim 1, where the step of placing the first wrapping on the group of products is performed using a tubular stretch film portion wound around first preforming means, stretching the film portion to form an access area whose transversal dimension is larger than the front, for a single group of products moving along the feed line, introducing the group of products into the stretched tubular film portion and releasing the stretch film portion over the product group so as to wrap the latter, wherein the step of placing the second wrapping comprises the following sequence of sub-steps:

winding a length of stretch film unrolled from a second roll around second means which are designed to preform an overwrapping and which are positioned inside a film wrapping area along the product group line of feed;

forming a second tubular portion of stretch film; stretching the second film portion by moving the second preforming means to create for the package moving along the feed line an access area whose cross section is at least equal to the longitudinal dimension;

releasing the second film portion to allow the second portion itself to shrink to its former size in such a way as to overwrap the package, while the gripping means simultaneously release the narrowed film segment;

narrowing down to strap size at least one segment of the second film portion, this step being performed by gripping means at the same time as the step of releasing the second portion;

feeding onto the feed line the package thus obtained.

4. The method according to claim 1, where the step of placing the first wrapping on the group of products is performed using a tubular stretch film portion wound around first preforming means, stretching the film portion to form an access area whose transversal dimension is larger than the front, for a single group of products moving along the feed line, introducing the group of products into the stretched tubular film portion, and releasing the stretch film portion over the product group so as to wrap the latter, wherein the step of placing the second wrapping comprises the following sequence of sub-steps:

winding a length of stretch film unrolled from a second roll around second means which are designed to preform an overwrapping and which are positioned inside a film wrapping area along the product group line of feed;

forming a second tubular portion of stretch film;

narrowing down to strap size at least one segment of the second film portion, this step being performed by gripping means;

stretching the second film portion by moving the second preforming means to create for the package moving along the feed line an access area whose cross section is at least equal to the longitudinal dimension;

releasing the second film portion to allow the second portion itself to shrink to its former size in such a way as to overwrap the package, while the gripping means simultaneously release the narrowed film segment;

feeding onto the feed line the package thus obtained.

5. The method according to claim 3, wherein the step of narrowing the second stretch film portion to strap size comprises a step of crimping at least an upper segment of it, corresponding to the part of it furthest away from a table on which the product group is fed, in such a way as to create an area by which the product group can be held in the hand.

6. The method according to claim 3, wherein the step of narrowing the second stretch film portion to strap size comprises a step of crimping at least an upper segment of it, corresponding to the part of it furthest away from a table on which the product group is fed, in such a way as to create two separate areas in the wrapping of the product group, that is to say, an upper area designed to be held in the hand, and a lower area wrapped around the base of the product group.

7. The method according to claim 4, wherein the step of narrowing the second stretch film portion to trap size comprises a step of crimping at least an upper segment of it, corresponding to the part of it furthest away from a table on which the product group is fed, in such a way as to create an area by which the product group can be held in the hand.

8. The method according to claim 4, wherein the step of narrowing the second stretch film portion to strap size comprises a step of crimping at least an upper segment of it, corresponding to the part of it furthest away from a table on which the product group is fed, in such a way as to create two separate areas in the wrapping of the product group, corresponding to the upper area designed to be held in the hand, and a lower area wrapped around the base of the product group.

9. A method for wrapping groups of products with stretch film comprising at least the following steps:

forming groups of individual products, each of said individual products having a width and each group of products having a front and a longitudinal dimension following a line of feed;

placing a first wrapping on the group of products to form a package that holds the products together;

feeding onto the feed line the package, wherein the feeding step is followed by the further steps of:

turning each package through an angle of 90°;

placing over the first wrapping a second stretch film wrapping on the package and forming the second stretch film wrapping to include an upper area having a width less than the width of the front of the group and defining at least one narrowed strap-like segment surrounding a part of the package, and a lower area having a width that supports the width of at least two of the individual products, wherein said at least one narrowed strap-like segment has a width less than a width of the individual products.

* * * * *